United States Patent [19]

Barton et al.

[11] Patent Number: 4,929,983

[45] Date of Patent: May 29, 1990

[54] STRIPPER MECHANISM

[75] Inventors: Arthur A. Barton, Webster; Frederick C. DeBolt, Penfield; Michael R. Elter, Webster; Paul M. Fromm, Rochester; Frank A. Grossi, Webster; Mark T. Miller, Rochester; Kenneth R. Rasch, Webster; Thomas F. Szlucha, Fairport, all of N.Y.

[73] Assignee: Xerox Corporation, Stamford, Conn.

[21] Appl. No.: 334,416

[22] Filed: Apr. 7, 1989

[51] Int. Cl.[5] ..... G03G 21/00

[52] U.S. Cl. ..... 355/315; 271/307; 271/900; 355/308; 355/309

[58] Field of Search ..... 355/308, 309, 315; 271/307, 311–313, 900; 118/245

[56] References Cited

U.S. PATENT DOCUMENTS

| | | | |
|---|---|---|---|
| 3,891,206 | 6/1975 | Bar-On | 271/900 |
| 3,957,423 | 5/1976 | Mueller | 118/245 X |
| 4,004,802 | 1/1977 | Brooke | 271/900 X |
| 4,060,320 | 11/1977 | Doi et al. | 355/315 |
| 4,320,953 | 3/1982 | Schultes et al. | 355/315 |
| 4,447,054 | 5/1984 | Sone | 271/311 |
| 4,687,696 | 8/1987 | Satojo | 428/192 |
| 4,748,473 | 5/1988 | Tsuruoka | 355/315 |
| 4,755,848 | 6/1988 | Tamary | 355/315 |
| 4,771,310 | 9/1988 | Leo et al. | 355/315 |
| 4,796,880 | 1/1989 | Tamary | 271/900 X |
| 4,806,985 | 2/1989 | Foley et al. | 271/311 X |

FOREIGN PATENT DOCUMENTS

| | | | |
|---|---|---|---|
| 2245274 | 10/1987 | Japan | 355/315 |

*Primary Examiner*—A. T. Grimley
*Assistant Examiner*—M. Smith

[57] ABSTRACT

A stripper for separating a print substrate from a fuser member in an electrostatographic printing machine has a substantially flat, thin, resiliently flexible finger-like member having a raised dimple-like bump adjacent one end of the finger-like member for contacting the print substrate when stripped from the fuser member, the finger-like member being coated on both sides with a smooth low surface energy film.

23 Claims, 5 Drawing Sheets

STRIPPER MECHANISM

CROSS REFERENCE TO RELATED APPLICATIONS

Reference is made to the following copending applications filed concurrently herewith: U.S. Application Ser. No. 07/334414, entitiled "FUSER APPARATUS" in the name of DeBolt et al. (our reference D/88264); U.S. Application Ser. No. 07/334415 entitled "FUSER RELEASE AGENT MANAGEMENT CONTROL" in the name of DeBolt et al (our reference D/88262); and U.S. Applicatin Ser. No. 07/334413 entitled "STRIPPER MECHANISM FOR REMOVING COPY SUBSTRATES FROM A SOFT ROLL FUSER" in the name of Paul M. Fromm (our reference D/89027).

BACKGROUND OF THE INVENTION

The present invention relates to a stripper mechanism for electrostatographic printing machines and more particularly to a stripper member for stripping a print substrate from a fuser member.

In an electrostatographic reproducing apparatus commonly in use today, a photoconductive insulating member is typically charged to a uniform potential and thereafter exposed to a light image of an original document to be reproduced. The exposure discharges the photoconductive insulating surface in exposed or background areas and creates an electrostatic latent image on the member which corresponds to the image areas contained within the usual document. Subsequently, the electrostatic latent image on the photo conductive insulating surface is made visible by developing the image with developing powder referred to in the art as toner. Most development systems employ a developer material which comprises both charged carrier particles and charged toner particles which triboelectrically adhere to the carrier particles. During development the toner particles are attracted from the carrier particles by the charge pattern of the image areas on the photoconductive insulating area to form a powder image on the photoconductive area. This image may subsequently be transferred to a support surface such as copy paper to which it may be permanently affixed by heating or by the application of pressure. Following transfer of the toner image to a support surface, the photoconductive insulating member is cleaned of any residual toner that may remain thereon in preparation for the next imaging cycle.

One of the more conventional approaches to fixing the toner image is through the use of heat and pressure by passing the print substrate containing the unfused toner images between a pair of opposed roller members at least one of which is internally heated. During this procedure, the temperature of the electroscopic toner material is elevated to a temperature at which the toner material coalesces and becomes tacky. This heating causes the toner to flow to some extent into the fibers or pores of the support member. Thereafter, as the toner material cools, solidification of the toner material causes the toner material to become bonded to the support member. Typical of such fusing devices are two roll systems wherein the fuser roll is coated with an abhesive material such as a silicone rubber or other low surface energy elastomer. The silicone rubbers that can be used as the surface of the fuser member include room temperature vulcanizable silicones referred to as RTV silicones liquid injection moldable or extrudable silicone rubbers and high temperature vulcanizable silicones referred to as HTV silicones.

During the fusing process and despite the use of low surface energy materials as the fuser roll surface, there is a tendency for the copy print substrate to remain tacked to the fuser roll after passing through the nip between the fuser roll and the pressure roll. When this happens, the tacked print substrate does not follow the normal substrate path but rather continues in an arcuate path around the fuser roll, eventually resulting in a paper jam which will require operator involvement to remove the jammed paper before any subsequent imaging cycle can proceed. As a result it has been common practice to use one or more techniques to ensure that the print substrate is stripped from the fuser roll downstream of the fuser nip. One of the common approaches has been the use of a stripper finger or a plurality of stripper fingers placed in contact with the fuser roll to strip the print substrate from the fuser roll. While satisfactory in many respects, this suffers from difficulties with respect to both fuser roll life and print quality. To ensure an acceptable level of stripping it is frequently necessary to load such a stripper finger against the fuser roll with such a force and at such an attack angle that there is a tendency to peel the silicone rubber off the fuser roll thereby damaging the roll to such an extent that it can no longer function as a fuser roll. In addition, since the finger comes in contact with the surface of the print substrate which has hot, just fused toner image there is a tendency for the stripper finger to scrape toner from the print substrate thereby creating a copy quality defect in the form of a line which may be the width of the stripper finger. Furthermore, while a stripper finger may only slightly deform the toner this may create a defect in the form of a stripe of higher gloss than the rest of the print. It has also been found that stripper fingers typically made of high energy materials become contaminated with toner on the side in contact with the fuser roll eventually resulting in the stripper finger lifting off the fuser roll and resulting in paper jams. As a result of the difficulties associated with stripper fingers use has been taken in many instances of air stripping systems. While satisfactory in many respects, the air stripping systems are typically very expensive involving elaborate air delivery mechanisms.

PRIOR ART

U.S. Pat. No. 4,687,696 to Satoji describes a finger strip for separating sheets of paper from a fuser roll in a copying machine which is made of a heat resistant resin and has at least a tip portion coated to a thickness of about 40 angstroms to 1 micron of fluorinated polyether polymer to improve lubricity and add anti-stickiness. High adhesion strength between the coating and the172 help to eliminate the problem of poor separation and jamming of paper.

SUMMARY OF THE INVENTION

In accordance with the principle aspect of the present invention, a stripper member for separating a print substrate from a fuser member in an electrostatographic printing machine has a substantially flat thin resiliently flexible finger-like member having a raised dimple-like bump adjacent one end for contacting the print substrate when stripper from the fuser member, the finger-like member being coated on both sides with a low surface energy film.

In accordance with a further principle aspect of the present invention, electrostatographic printing apparatus comprising a fuser roll and a pressure roll defining a nip therebetween includes a stripping assembly adjacent to the fuser for stripping the print substrate therefrom which comprises a mounting baffle and at least one stripper member in accordance with the present invention being in stripping engagement with the fuser roll.

In accordance with a further aspect of the present invention, the coated finger-like member is from about 0.005 to about 0.007 inches in thickness.

In accordance with a further aspect of the present invention, the raised dimple bump is substantially hemispherical and has a height from about 0.015 to about 0.025 inches.

In accordance with a further aspect of the present invention, the low surface energy film is a substantially continuous film of a fluorocarbon resin, preferably a perfluoroalkoxy fluorocarbon resin.

In accordance with a further aspect of the present invention, the low surface energy film on the raised dimple side of the finger-like member is thicker than the film on the inner side of the finger-like member.

In accordance with a further aspect of the present invention, the film on the raised dimple side of the finger-like member is from about 0.0008 to about 0.0025 inches thick and the film on the inner side of the finger-like member is from about 0.0002 to about 0.0016 inches thick.

In a further principle aspect of the present invention, a plurality of stripper members are mounted to the mounting baffle for stripping engagement with a fuser roll and the mounting baffle is fixedly mounted relative to the roll pair such that the stripper members are in stripping engagement with the fuser roll at an angle of from about 10° to 20° and preferably 14° to about 16° with respect to the tangent at the point of contact between finger and of the fuser roll.

In a further aspect of the present invention, the stripper members are mounted to provide a normal force on the fuser roll of from about 10 to a bout 20 grams and preferably 13–17 grams.

In a further aspect of the present invention, print substrate guides are mounted to the baffle adjacent the stripper members to guide print substrates away from the stripper members.

DESCRIPTION OF THE PREFERRED EMBODIMENT

The invention will now be described with reference to a preferred embodiment of an electrostatographic printing apparatus.

Figure 1:
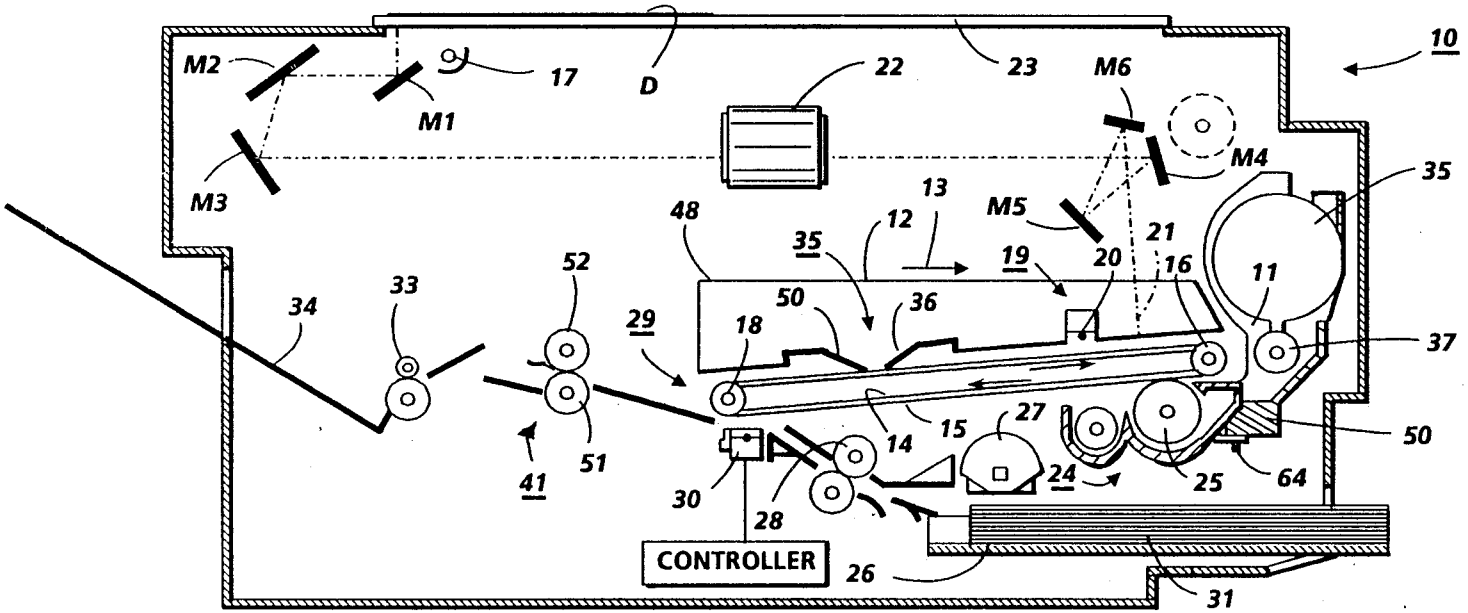
FIG. 1 is a schematic representation in cross section of an automatic electrostatographic printing machine with the stripper mechanism according to the present invention.

Referring now to FIG. 1, there is shown by way of example, an automatic electrostatographic reproducing machine 10 which includes a removable processing cartridge 12. The reproducing machine depicted in IG. 1 illustrates the various components utilized therein for producing copies from an original document. Although the invention is particularly well adapted for use in automatic electrostatographic reproducing machines, it should become evident from the following description that it is equally well suited for use in a wide variety of processing systems including other electrostatographic systems and is not necessarily limited in application to the particular embodiment shown herein.

The reproducing machine 10 illustrated in FIG. 1 employs a removable processing cartridge 12 which may be inserted and withdrawn from the main machine frame in the direction of arrow 13. Cartridge 12 includes an image recording belt-like member 14 the outer periphery of which is coated with a suitable photoconductive material 15. The belt is suitably mounted for revolution within the cartridge about driven transport roll 16, around idler roll 18 and travels in the direction indicated by the arrows on the inner run of the belt to bring the image bearing surface thereon past the plurality of xerographic processing stations. Suitable drive means such as a motor, not shown, are provided to power and coordinate the motion of the various cooperating machine components whereby a faithful reproduction of the original input scene information is recorded upon a sheet of final support material 31, such as paper or the like.

Initially, the belt 14 moves the photoconductive surface 15 through a charging station 19 wherein the belt is uniformly charged with an electrostatic charge placed on the photoconductive surface by charge corotron 20 in known manner preparatory to imaging. Thereafter, the belt 14 is driven to exposure station 21 wherein the charged photoconductive surface 15 is exposed to the light image of the original input scene information, whereby the charge is selectively dissipated in the light exposed regions to record the original input scene in the form of electrostatic latent image.

The optical arrangement creating the latent image comprises a scanning optical system with lamp 17 and mirrors $M_1$, $M_2$, $M_3$ mounted to a a scanning carriage (not shown) to scan the original document D on the imaging platen 23 lens 22 and mirrors $M_4$, $M_5$, $M_6$ to transmit the image to the photoconductive belt in known manner. The speed of the scanning carriage and the speed of the photoconductive belt are shnchronized to provide faithful reproduction of the original document. After exposure of belt 14 the electrostatic latent image recorded on the photoconductive surface 15 is transported to development station 24, wherein developer is applied to the photoconductive surface 15 of the belt 14 rendering the latent image visible. The development station includes a magnetic brush develpment system including developer roll 25 utilizing a magnetizable developer mix having course magnetic carrier granules and toner colorant particles supplied from developer supply 11 and auger transport 37.

Sheets 31 of the final support material are supported in a stack arranged on elevator stack support tray 26. With the stack at its elevated position, the sheet separator segmented feed roll 27 feeds individual sheets therefrom to the registration pinch roll pair 28. The sheet is then forwarded to the transfer station 29 in proper registration with the image on the belt and the developed image on the photoconductive surface 15 is brought into contact with the sheet 31 of final support material within the transfer station 29 and the toner image is transferred from the photoconductive surface 15 to the contacting side of the final support sheet 31 by means of transfer corotron 30. Following transfer of the image, the final support material which may be paper, plastic, etc., as desired, is separated from the belt by the beam strength of the support material 31 as it passes around the idler roll 18, and the sheet containing the toner image thereon is advanced to fixing station 41 comprising heated fuser roll 52 and pressure roll 51 forming a nip therebetween wherein roll fuser 52 fixes the tranferred powder image thereto. After fusing the toner image to the copy sheet the sheet 31 is advanced by output rolls 33 to sheet stacking tray 34.

Although a preponderance of toner powder is transferred to the final support material 31, invariably some residual toner remains on the photoconductive surface 15 after the transfer of the toner powder image to the final support material. The residual toner particles remaining on the photoconductive surface after the transfer operation are removed from the belt 14 by the cleaning station 35 which comprises a cleaning blade 36 in scrapping contact with the outer periphery of the belt 14 and contained within cleaning housing 48 which has a cleaning seal 50 associated with the upstream opening of the cleaning housing. Alternatively, the toner particles may be mechanically cleaned from the photoconductive surface by a cleaning brush as is well known in the art.

It is believed that the foregoing general description is sufficient for the purposes of the present invention to illustrate the general operation of an automatic xerographic copier 10 which can embody the apparatus in accordance with the present invention.

Figure 2:
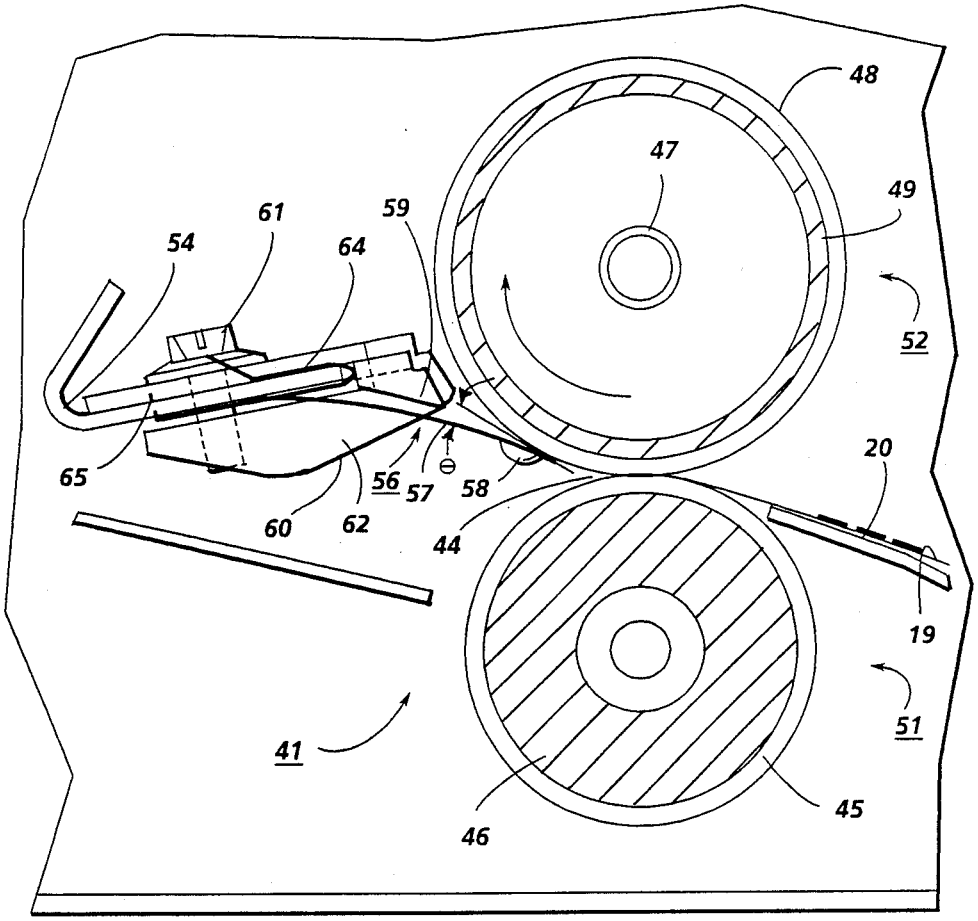
FIG. 2 is an enlarged cross sectional view of the stripper mechanism according tot he present invention in association with the fusing system.
Figure 3:
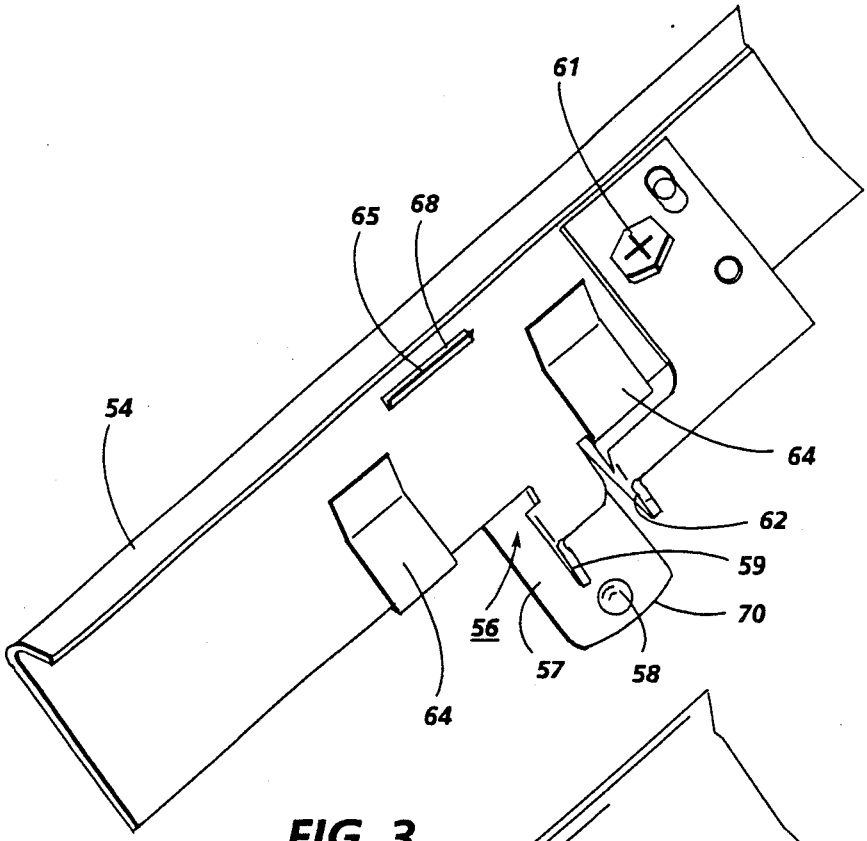
FIGS. 3 and 3A are isometric views of the mounting baffle which may have a plurality of stripper members mounted thereto and a plurality of print substrate guides.
Figure 3A:
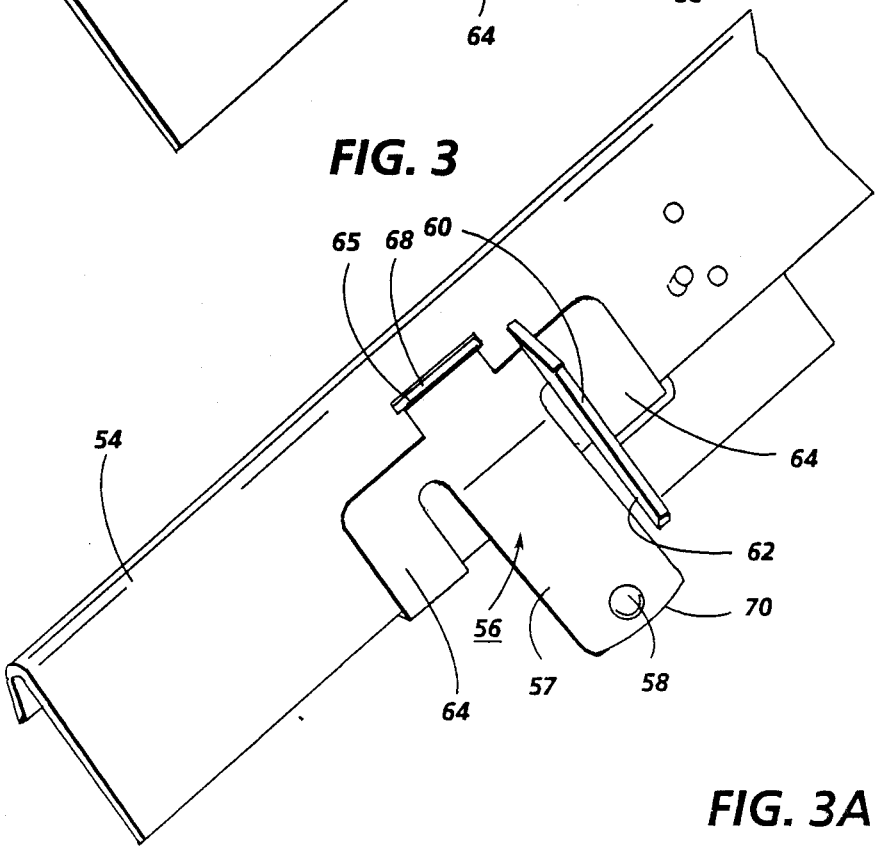

Turning now to FIGS. 2, 3, and 3A the stripper mechanism according to the present invention will be described in greater detail. As shown in FIG. 2, the fuser roll 52 is composed of a core 49 having coated thereon a thin layer 48 of an elastomer. The core 49 may be made of various metals such as iron, aluminum, nickel, stainless steel, etc., and various synthetic resins. Aluminum is preferred as the material for the core 49, although this is not critical. The core 49 is hollow and a heating element 47 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention, and the fuser member can be heated by internal means, external means ro a combination of both. All heating means are well known in the art for providing sufficient heat to fuse the toner to the support. The thin fusing elastomer layer may be made of any of the well known materials such as the RTV and HTV silicone elastomers referred to above.

The fuser roll 52 is shown in a pressure contact arrangement with a backup or pressure roll 51. The pressure roll 51 comprises a metal core 46 with a layer 45 of a heat-resistant material. In this assembly, both the fuser roll 52 and the pressure roll 51 are mounted on shafts (not shown) which are biased so that the fuser roll 52 and pressure roll 51 are pressed against each other under sufficient pressure to form a nip 44. It is in this nip that the fusing or fixing action takes place. It has been found that the quality of the copies produced by the fuser assembly is better when the nip is formed by a relatively hard and thick layer 45 with a relatively flexible thin layer 48. In this manner, the nip is formed by a slight deformation in the layer 48 and major deformation of layer 45 due to the loading of the fuser roll 52 to the pressure roll 51. The layer 45 may be made of any of the well known materials such as fluorinated ethylene-propylene copolymer or silicone rubber.

Figure 4:
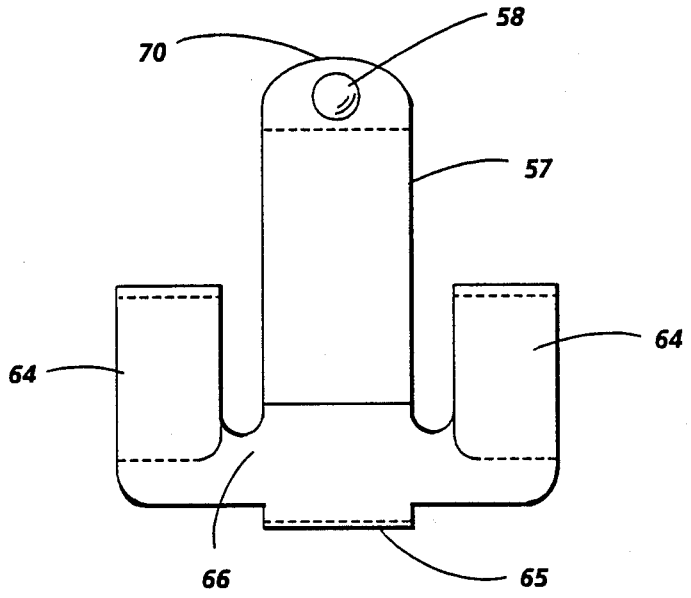
FIG. 4 is a plan view of one stripper member.
Figure 5:
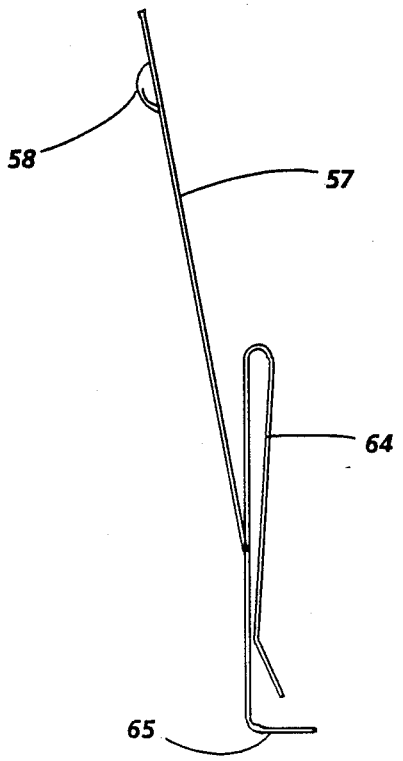
FIG. 5 is a side view of one stripper member.

The stripper member 56 comprises a finger-like member 57 having a raised dimple-like bump 58 at one end. Attention is now directed to FIGS. 4 and 5 for a more detailed explanation of the individual stripper members. In addition to the stripper member comprising a finger-like member 57, it is provided with two holder elements 64, one on each side of the finger-like member 57 and connected thereto by a stretcher element 66 all of which are preferably formed from a one-piece member. The holder elements 64 are formed by folding over two narrower finger-like members one on each side of the finger-like members 57 which may be formed by stamping the sheet metal stock in such a way as to form a spring clip, which is engageable with the mounting baffle 54 to hold the stripper member on the mounting baffle in association with keeper flap 65 which when the stripper member is mounted on the mounting baffle drips into mounting slot 68 (see FIGS. 3 and 3A)) securing the stripper member to the mounting baffle.

Turning once again to FIGS. 2,3 and 3A, the mounting baffle 54 which is fixedly secured to frame members on each side of the printing machine, not shown, has a print substrate guide 62 having a deflector surface 60, affixed thereto by means of screw 61. As illustrated in FIGS. 3 and 3A, each of the stripper finger-like members 57 is positioned adjacent to such a print substrate guide. In addition a restrainer or backstop 59 is formed in the mounting baffle for each stripper member to provide a minimum angle of the stripper member with respect to the tangent at the point of contact between the finger and the fuser roll and to prevent excessive deflection of the finger-like member 57 during hard stripping.

The stripper member comprises a substantially flat resiliently flexible finger-like member that is capable of providing an essentially constant load on the fuser roll with small positional variations. Furthermore, in addition to maintaining substantially constant contact with the fuser roll and promoting stripping of a print substrate therefrom is should not provide any substantial wear to the fuser roll. Accordingly, a substantially flat de-burred finger-like member is preferred. The finger like member may be made from any suitable material. Typical materials include spring steel, 304 $\frac{3}{4}$ hard stainless steel, 301 full hard stainless steel, full hard steel being particularly preferred because of its higher yield strength. As illustrated in FIG. 4, the front of the finger-like member is rounded at the end which comes in contact with the fuser roll to minimize the contact area with the fuser roll. Typically, the uncoated finger-like member is from about 0.0035 inches to about 0.0045 inches in thickness and preferably is about 0.004" in thickness. A thinner finger-like member tends to yield too easily. The raised dimple-like bump which may be formed in the finger-like member by molding, stamping, or punching provides a good paper transition (separation from the finger to the print substrate guides). The dimple is provided at the end of the finger-like member as far forward as possible that it can be formed without causing any deformation in the rounded portion in front of the dimple. Since the purpose of the dimple is to provide the sole contact between the stripper finger and the image side of the print substrate to thereby minimize the size of the copy quality defect by minimizing contact area to only that portion of the dimple which contacts the print substrate which disturbs less toner, the dimple is preferably large enough to ensure that the remainder of the finger-like member does not contact the print substrate but not so large as to form a stop member thereby creating a jam when a substrate contacts the dimple. Typically, the dimple takes the form of a substantially hemispherical solid and has a height of from about 0.015 to about 0.025 inches.

Figure 6:
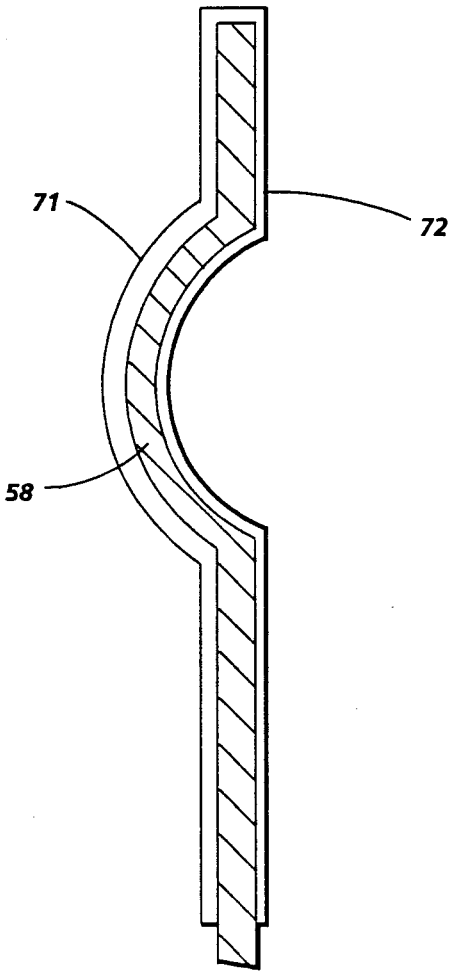
FIG. 6 is an enlarged partial sectional view of a stripper member.

The individual finger-like members are coated on both sides with a low surface energy, highly wear resistant material. Typical such materials include fluorocarbon resins such as tetrafluoroethylene resins, perfluoroalkoxy fluorocarbon resins, fluorinated ethylene-propylene resins. Suitable commercially available materials include the series of fluorocarbon resins available under the trademark "TEFLON" from E. I. duPont DeNemours & Company, Inc. Wilmington, Del. Typical materials include TEFLON-P, PFA Powder Coating 532-5010; TEFLON TE-9705, both perfluoroalkoxyfluorocarbon resins. In addition, the copolymer of ethylene and tetrafluoroethylene also available from the duPont Company under the Trademark "Tefgel" fluoropolymer powder coating 532-6000 may also be used. Another useful tetrafluoroethylene resin is that available under the Trademark XYLAR 201B from Whitford Corporation, West Chester, Pa. Another low surface energy, high wear resistant suitable material are the polypheneylene sulfide liquid systems. The above materials typically provide coatings having a surface energy less than about 25 dynes per centimeter. The perfluoroalkoxy fluorocarbon resins referred to above are preferred because they have very low surface energy of about 18 dynes per centimeter and are highly wear resistant. The low surface energy coating on the inner side (side adjacen the fuser roll) of the finger-like member functions to provide a surface on which otherwise contaminating toner particles would collect resulting in a lifting of the finger-like member from the surface of the fuser roll, resulting in a stripping failure and a paper jam. It has been found that contaminating toner tends to collect on the inner side of the stripper member, eventually resulting in lifting the stripper member from the fuser roll and resulting in a paper jam. This is because the toner particles which are not fused are typically high surface energy materials and once they start to collect (toner attracts toner) a build-up of the toner particles is formed on the inner side of the finger-like member, leading to finger lift off. In addition, the toner debris is loaded with paper fibers and the collection of this debris between the finger-like member and the fuser roll causes roll wear since the fiber reinforced toner is stiff and abrasive. By providing a low surface energy coating on the inner portion of the finger-like member, toner does not adhere to the stripper finger and as additional or new toner comes into the stripping area old toner is moved to the rear of the stripper finger rather than accumulating to a level sufficient to displace the stripper finger. The low surface energy coating on the side of the finger-like member having the raised dimple-like bump minimizes image disturbance of the fused toner image on the substrate in that the higher surface energy toner material does not adhere to the low surface energy coating and the frictional forces are lower due to the lower coefficient of friction of the low surface energy coating. It is important that the coating on the inner side of the finger-like member be as thin as possible to reduce overall finger thickness thereby minimizing paper jams. It has been found that if the coating on either side of the finger is too thick it tends to make the finger too thick causing an initial mistrip followed by a paper jam with very light weight papers. Accordingly the thickness of the low surface energy coating or film 72 on the inner side of the finger-like member is from about 0.0002 to about 0.0016 inches and preferably about 0.0014 inches. In this regard attention is directed to FIG. 6 wherein the difference in the coating thickness is illustrated. The thickness of the low surface energy coating or film 71 on the dimple side of the finger-like member is from about 0.0008 to about 0.0025 inches and preferably is about 0.0018 inches. In addition to the coating having a low surface energy it is relatively uniform without undulations, peaks and valleys which may have different release characteristics. Typically, it has a surface finish less than 0.2 micrometers.

The low surface energy coating may be applied to the finger-like member in any suitable manner. Typically the stamped finger-like member is deburred and degreased. The surface may be roughened slightly to promote adhesion. In addition, a primer is preferably used to promote adhesion of the low surface energy coating. Typical commerically available primers for the fluorocarbon polymers include the two package Primer(an acid accelerator portion and a Teflon portion) such as UM-7799 Accelerator and the 850-300 Line which are also available from E.I. duPont deNemours Company, Inc. In addition, EMARLON 301A, an aqueous slurry of about 60% by weight of polytetrafluoroethylene and EMARLON 301B an acid solution of chromic and phosphoric acid available from Acheson Colloids Company Port Huron, Michigan may be used. The primer is applied at a thickness of from about 0.0001 to about 0.0005 inches to both sides of the finger-like member to provide a total coating thickness of from about 0.0009 to about 0.0030 inches on the dimple side and from about 0.0003 to about 0.0021 inches on the inner side. The primer is dried or baked followed by spraying the low surface energy coating on the side of the finger-like member having the raised dimple-like bump and relying on the spray wraparound to adequately coat the inner side of the finger-like member. The fluorocarbon resins may be applied by hand spraying a powder coating of the resin onto the finger-like member followed by baking in an oven at elevated temperatures of 740° F. for about 30 minutes for example.

Referring once again to FIG. 2, the stripper member is mounted relative to the fuser roll to minimize roll damage and to provide a good transition angle for the print substrate to be stripped from the roll so that it is does not stub up against the end of the finger-like member or the dimple. Typically, the mounting angle $\theta$ (the angle formed between the finger-like member with respect to the tangent at the point of contact between the finger and the fuser roll) is from about 10° to about 20° and preferably is about 14° to 16°. In this regard it is noted that if a very shallow angle is used the tendency for poor stripping is increased and if a steeper angle is used the tendency for damage to the fuser roll by abrasion or cutting into the roll is increased. To insure stripping, the finger-like members are placed in contact with the fuser roll under a force, which is balanced between a high load resulting in increased wear to the fuser roll, and a lower load resulting in stripping difficulties and increased jam rate. Typically, the force applied is from about 10 grams to about 20 grams and is preferably from about 13 grams to about 17 grams. In addition the end of the stripper-like member in contact with the fuser roll is mounted such that it is about three millimeters from the roll nip thereby providing stripping at a point where the print substrate has not been forced to the fuser roll for a substantiall distance.

With further reference to FIGS. 2 and 3, the print substrate guides are provided to minimize contact of the stripper finger by the print substrate thereby minimizing wearing of the low surface energy coating therefrom and thereby minimizing any copy quality defect. If the paper guides are not used, the print substrate tends to ride up on the finger-like member wearing off the coating which will eventually provide a higher surface energy surface yielding a greater copier defect. Typically, the finger-like members are in contact with the print substrate for about the first three millimeters of the print prior to the leading edge of the print substrate contacting the substrate guides lifting the substrate off the stripper fingers. In addition the print substrate guides contribute to minimizing the occurrence of curl in the copy sheets.

The above described stripper mechanism is effective in stripping substrates from light weight paper to heavy weight paper as well as specialty substrates such as film substrates such as polyethylene transparencies. Typical paper weights are form about 13 to about 110 pounds.

Thus according to the present invention a simple relatively inexpensive stripper mechanism is provided which minimizes the copy quality defect achieved in prior stripping circumstances and also minimizes wear on the fuser roll. For example, and for comparative purposes a fixture resembling a device indicated in FIG. 2 was evaluated using dark dusting images on paper. Dark dusting images on paper are formed by uniformly charging an area of a photoreceptor, developing the entire area and transferring that area to the copy sheet. There is no image, just an area of infused toner. The fixture was evaluated with four different finger-like members attached to the stripping baffle. First a simple stainless steel finger was evaluated which provided a copy quality defect the width of the finger in that the toner image was disturbed and removed down to the paper surface at the finger edges. The second finger-like member comprised a similar stainless steel finger having a dimple according to the present invention on the surface of the finger-like member. The copy quality defect produced by this device was merely the width of the dimple. However, toner tended to buildup on the inner side of the finger-like member resulting in a paper jam within one to two thousand copies. The frequency of jamming was more severe with lighter weight paper. The third finger-like member was a similar stainless steel finger-like member having a low surface energy coating on both sides thereof and while the copy quality defect was not as severe as with the uncoated stainless steel finger-like member it was present across the entire width of the finger-like member. Toner did not collect on the inner side of the stripper finger to any sufficient degree to result in lifting the finger-like member from the fuser roll. Finally the finger like member had both a raised dimple-like bump and the low surface energy coating. This provided very minimal contact between the finger-like member and the print substrate with a low copy quality defect the size of the contacted area of the dimple which was imperceptible to the naked eye.

The patents referred to herein are hereby specifically and totally incorporated herein by reference.

While the invention has been described with reference to specific embodiments, it will be apparent to those skilled in the art that many alternatives, modifications and variations may be made. For example, while the invention has been illustrated with an electrostatic latent image formed by the exposure of an electrostatically charged photoconductive member to a light image of an original document, the electrostatic latent image may alternatively be generated from information electronically stored or generated in digital form which afterwards can be converted to alphanumeric images by image generation and electronics and optics. In addition while the stripper mechanism has been illustrated as stripping a print substrate from a fuser roll, it is equally capable of functioning and stripping prints from an imaging surface. Accordingly, it is intended to embrace all such alternatives, modifications that may fall within the spirit and scope of the appended claims.

We claim:

1. A stripper member for separating a print substrate from a fuser member in an electrostatographic printing machine comprising a substantially flat, thin, resiliently flexible finger-like member having a raised dimple-like bump adjacent one end of said finger-like member for contacting said print substrate when stripped from said fuser member, said finger-like member being coated on both sides with a smooth low surface energy film.

2. The stripper member of claim 1 wherein the coated finger-like member is from about 0.005 to about 0.007 inches in thickness.

3. The stripper member of claim 1 wherein said one end of said finger-like member is rounded.

4. The stripper member of claim 1 wherein said raised dimple bump is substantially hemispherical.

5. The stripper member of claim 4 wherein said bump has a height of from about 0.015 to about 0.025 inches.

6. The stripper member of claim 1 wherein said low surface energy smooth film is a substantially continuous film of a fluorocarbon resin.

7. The stripper member of claim 6 wherein said fluorocarbon resin is a perfluoroalkoxy fluorocarbon resin.

8. The stripper member of claim wherein the film on the raised dimple side of the finger-like member is thicker than the film on the opposite side of the finger-like member.

9. The stripper member of claim 8 wherein the film on the raised dimple side of the finger-like member is from about 0.0008 to about 0.0025 inches thick and the film on the inner side of the finger-like member is from about 0.0002 to about 0.0016 inches thick.

10. Electrostographic printing apparatus comprising a fuser roll and a pressure roll defining a nip therebetween, a stripping assembly adjacent said fuser roll for stripping a print substrate therefrom, said assembly comprising a mounting baffle and mounted thereto at least one stripper member comprising:

a substantially flat, thin, resiliently flexible finger-like member having a raised dimple-like bump adjacent one end of said finger-like member for contacting a print substrate when stripped from said fuser member, said finger-like member being coated on both sides with a smooth low surface energy film, said at least one member being in stripping engagement with said fuser roll.

11. The apparatus of claim 10 wherein said mounting baffle is fixedly mounted relative to said roll pair such that said at least one stripper member is in stripping engagement with said fuser roll at an angle with respect to the tangent at the point of contact between the finger and bottom of the fuser roll of from about 10° to about 20°.

12. The apparatus of claim 11 wherein said angle is about 14°.

13. The apparatus of claim 10 wherein said at least one stripper member is mounted to provide a normal force on said fuser roll of from about 10 to about 20 grams.

14. The apparatus of claim 10 wherein said at least one stripper member is mounted so that said one end of said finger-like member is about 3 millimeters downstream of said fuser roll and pressure roll nip.

15. The apparatus of claim 10 wherein said at least one stripper finger comprises a plurality of stripper members mounted to said baffle for stripping engagement with said fuser roll along a line on said fuser roll parallel to its axis and further including print substrate guides mounted to said baffle adjacent said stripper members to guide said substrate away from said stripper members.

16. The apparatus member of claim 10 wherein the coated finger-liked member is from about 0.005 to about 0.007 inches in thickness.

17. The apparatus of claim 10 wherein said one end of said finger-like member is rounded.

18. The apparatus of claim 10 wherein said raised dimple-like bump is substantially hemispherical.

19. The apparatus of claim 18 wherein said bump has a height of from about 0.015 to about 0.025 inches.

20. The apparatus of claim 10 wherein said low surface energy smooth film is a substantially continuous film of a fluorocarbon resin.

21. The apparatus of claim 20 wherein said fluorocarbon resin is a perfluoroalkoxy fluorocarbon resin.

22. The apparatus of claim 10 wherein the film on the raised dimple side of the finger-like member is thicker than the film on the opposite side of the finger-like member.

23. The apparatus of claim 22 wherein the film on the raised dimple side of the finger-like member is from about 0.0008 to about 0.0025 inches thick and the film on the opposite side of the finger-like member is from about 0.0002 to about 0.0016 inches thick.

* * * * *